United States Patent [19]

Giuliani

[11] Patent Number: 4,651,387

[45] Date of Patent: Mar. 24, 1987

[54] CARDING MACHINE PROVIDED WITH SELF-CLEANING BLADE OR REED ELEMENTS

[76] Inventor: Marcello Giuliani, Vua Cellerese 33, 50013 Campi di Bisenzio (Firenze), Italy

[21] Appl. No.: 718,885

[22] Filed: Apr. 2, 1985

[51] Int. Cl.[4] ..... D01G 15/24

[52] U.S. Cl. ..... 19/113; 19/114

[58] Field of Search ..... 19/113, 114

[56] References Cited

U.S. PATENT DOCUMENTS 462,121 10/1891 Foss ..... 19/113 X 2,937,413 5/1960 Hollingsworth ..... 19/114

FOREIGN PATENT DOCUMENTS 0005884 of 1886 United Kingdom ..... 19/113

*Primary Examiner*—Louis K. Rimrodt

*Attorney, Agent, or Firm*—Bucknam and Archer

[57] ABSTRACT

The carding machine comprises a plurality of carding elements extending in a continuous way near a back cylinder (2), effective to rotate about its axis, and supported by supporting elements (1) which define, at the back-cylinder side, an attaching lug (3) to be engaged with a seat (4) formed in each carding element (5), which carding element consists of a plurality of carding blades or reeds arranged in an adjoining relationship and circumpherentially extending with respect to the back-cylinder (2), the inlet end portion of the carding reeds being arranged near the outlet end portion of the reeds of the carding element located on the preceding supporting element (1).

1 Claim, 5 Drawing Figures

CARDING MACHINE PROVIDED WITH SELF-CLEANING BLADE OR REED ELEMENTS

The present invention relates to a carding rod carding machine, for carding fibers in general, provided with self-cleaning blade or reed members.

As it is known, the carding-rod carding machines are usually formed by a plurality of supporting elements, arranged in an adjoining relationship, which are continuously driven or displaced about an abutment cylinder which is caused to rotate about its axis.

The mentioned supporting elements are of elongated shape in the cylinder axial direction and consist of a plurality of carding blades or reeds, which are arranged in an adjoining relationship according to a perpendicular direction to the longitudinal extension of the supporting elements.

In the known arrangement, at the ends of the individual carding reeds, a unactive region is formed, that is a region devoid of any teeth processing the fibers during the carding operation.

Thus, in the mentioned region, fibers are inevitably curled, since the fibers can not be easily taken by the teeth and a undesired build-up of material occurs, which remarkably reduces the processing operating efficiency.

Another drawback of the known carding-rod carding machines is that the carding reeds or blades are provided, at the bottom near their operating edge, a substantially rectilinear extension tangentially arranged with respect to the surface of the mentioned abutment or back cylinder.

Accordingly, at the end portions of the carding reeds there is, with respect to the abutment cylinder, a distance greater than that which is defined between the carding reeds and the cylinder, at the intermediate portion thereof.

Thus an uneven processing will be obtained, since the carding action the fibers are subjected to is a greatly variable and uneven one, along the extension of the individual carding reeds.

Moreover, the shape of the reeds presently used in known carding machines, while affording an efficient engaging of the fibers and teeth, is such as to cause, under each reed, a great build-up of material, susceptible to obstruct or clog the reeds, thereby reducing the carding efficiency.

Thus, the task of the present invention is to overcome the above mentioned drawbacks by providing a carding-rod carding machine provided with a carding reed or blade active working region extending through the overall periphery of the abutment or back cylinder without any discontinuities at the transition region between a carding element and the next carding element.

Within that task, it is a main object of the present invention to provide such a carding-rod carding machine in which the individual carding reeds or blades are shaped in such a way as to provide an even effect all along their longitudinal extension, thereby facilitating the engaging and even stretching of the fibers.

Another object of the present invention is to provide a carding-rod carding machine which does not cause any curling or build-up of the fibers, thereby providing an even arrangement of fibers about the back-cylinder.

Yet another object of the present invention is to provide such a carding-rod carding machine in which there is obtained an evenly progressive processing over the complete processing or operating region thereat the carding elements operate, thereby improving the structure of the layer of the fibers being processed.

Yet another object of the present invention is to provide such a carding-rod carding machine which is very reliable in operation.

According to one aspect of the present invention, the above task and objects, as well as yet other objects which will become more apparent hereinafter are achieved by a carding-rod carding machine for carding fibers in general, according to the appended claims.

Further characteristics and advantages of the carding-rod carding machine according to the present invention, will become more apparent thereinafter by the following description of a preferred, though not exclusive, of the carding machine itself, being illustrated, by way of an indicative example, in the figures of the accompanying drawings, in which.

Figure 1:
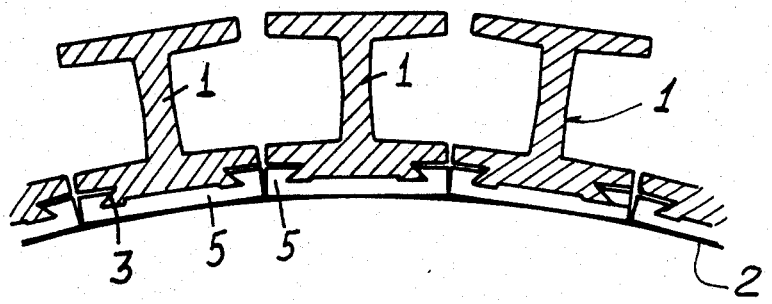
FIG. 1 is a schematic cross-sectional view illustrating a portion of the carding-rod carding machine according to the present invention, with a portion of the back-cylinder and a portion of the supporting elements.
Figure 2:
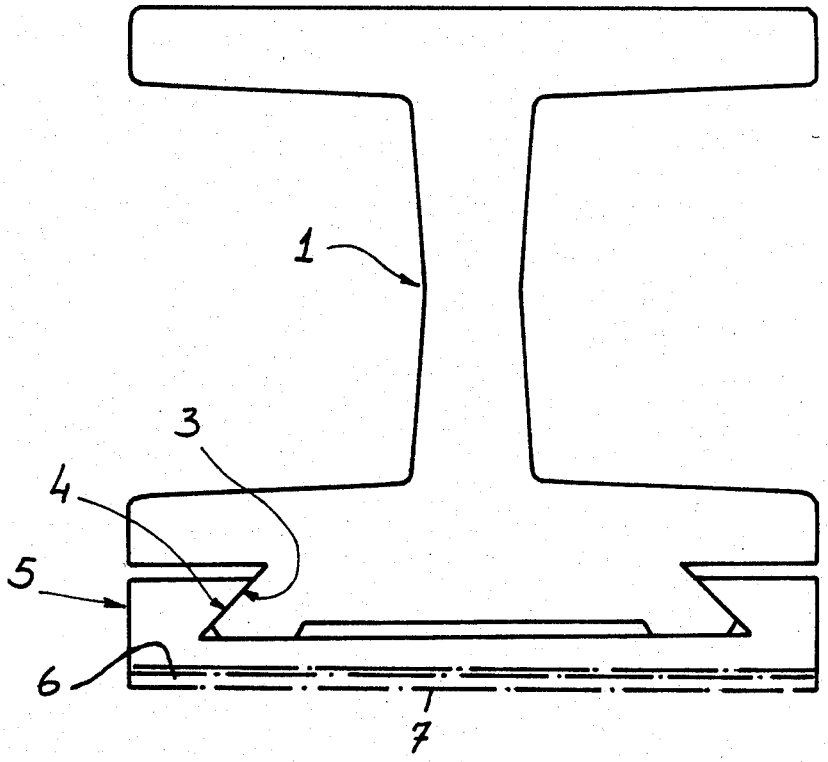
FIG. 2 illustrates, on a greatly enlarged scale, a supporting element with the related carding element.
Figure 3:
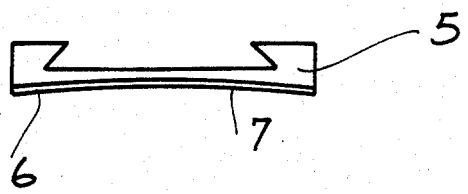
Figure 4:
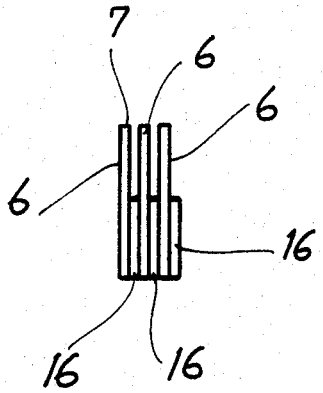
Figure 5:
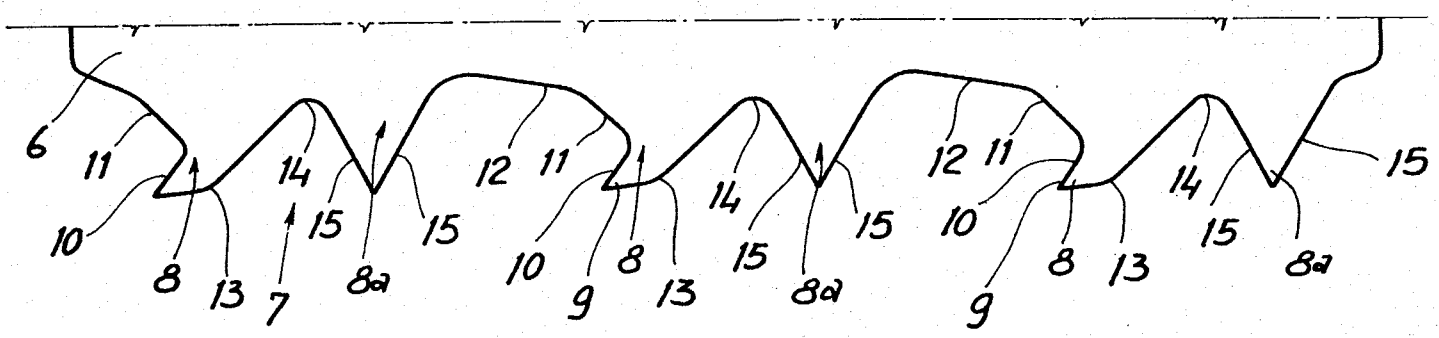

FIG. 3 schematically illustrates the arrangement of a carding element;

FIG. 4 illustrates the procedure for assembling the several carding blades or reeds in order to form a carding element; and FIG. 5 illustrates, on an enlarged scale, the profile of the assembled carding reed teeth, as assembled on the carding machine according to the present invention.

With reference to the mentioned figures of the accompanying drawings, the carding-rod carding machine according to the present invention, comprises a plurality of supporting elements, indicated overally at 1, which, advantageously are double-T shaped.

The mentioned supporting elements longitudinally extend, are located adjoining one another and extend in a continuous manner along a perpendicular direction to their extension direction, about a back cylinder 2 effective to be rotated about its axis, and parallely arranged to the extension direction of the individual supporting elements.

Each supporting element 1 is provided, at its lower or bottom end portion, with an attaching lug 3, advantageously of dove-tail shape, which may be engaged with the corresponding anchoring seat 4, also of dove-tail shape, as formed on the carding element 5 which is applied to each supporting element.

In actual practice, the thus constructed carding rods have such a shape which affords the possibility of easily inserting, in a perfectly engaged way, toothed blade sets, with spacers of different size.

In particular, since the mentioned blade or reed sets may be interexchanged by sectors, it will be possible to replace a possibly damaged sector in a very easy way, without the need of removing the remaining sectors.

Moreover, the carding rods may also be adjusted longitudinally and laterally; in addition, since the mentioned rods are fixed ones, they may be applied on the carding machine up to 360°, included the grill, which provides a carding grill.

Owing to the possibility of working through the complete 360° of the machine, the carding rod shape, furthermore, provides for the formation of interspaces or gaps in order to clean the fibers and remove from pressure the carded material.

It should moreover be pointed out that the mentioned carding rods have been so designed as to be adjusted in a very simple and precise way and that they may be produced starting from suitable moldable or extrudable materials.

The mentioned carding element 5 consists of a plurality of reeds or blades 6 which are arranged in an adjoining relationship and extend in a substantially perpendicular direction with respect to the axis of the abutment or back-cylinder with a mainly circumpherential configuration.

More specifically, the mentioned carding blades or reeds consist of a blade or reed element provided, at the bottom, with a tooth formation, generally indicated at the reference number 7.

The mentioned tooth formation is provided with pulling teeth, evenly alternated with orienting teeth 8*a*.

In particular, the pulling teeth have one end portion whereof, indicated at 9, the tip of which is turned in an opposite direction to the fiber advancing or feeding direction.

That tip portion, at the front whereof, is provided with a slant portion 10 meeting with a beveled portion 11 extending in an opposite direction to the slanted portion and meeting with a recessed portion 12.

On the extrados of the pulling tooth 8 there is formed an arc shaped portion 13 leading to a groove 14, followed by the tooth 8*a* which, at the rear, is arranged near to said pulling tooth.

More specifically, the tooth 8*a* has such a profile which is substantially symmetrical with respect to the perpendicular direction to the fiber advancing or feeding direction, thereby all of the sides 15 thereof form, therebetween, an angle which, advantageously, may be of 60°.

Moreover, the rear side 15 meets with the recessed portion 12.

With the disclosed arrangement, the particular profile of the pulling teeth 8 affords the possibility of providing an efficient carding operation and an easy discharging of the fibers which will be located downstream of the pulling teeth.

Thus, the carding blades or reeds will be held in a perfectly cleaned condition, without any material build-up.

In actual practice the fibers passing the mentioned pulling teeth will be engaged by the orienting teeth, provided with symmetrical tip portions, which will provide an ordered orientation of the fibers, thereby efficiently cleaning the carding blades or reeds and processing the fibers in a more even way.

It should moreover be pointed out that the tooth formation 7 extends, preferably, along a curved profile, having a substantially equal radius as, or an eventually greater radius, than the radius of the back-cylinder of the carding machine in such a way as to prevent any discontinuities in the distance between the carding blades and back cylinder from occurring, during the working or processing steps of the carding machine.

The above-mentioned blades or reeds, in particular, are intercalated with spacer elements 16 the thickness whereof may be varied, depending on the specific needs, in order to better fit the characteristics of the fibers being processed.

The attaching lug 3 of the carding elements, furthermore, is located in such a way that said carding elements are supported in a slanted way, with respect to the tangential direction of the back cylinder.

Thus, the fibers fed to the carding machine are subjected to a progressive type of mechanical action since, at the inlet portion or inlet end, the spacing between the carding element and back cylinder is greater than the distance which is provided at the outlet end.

Moreover, each carding element is arranged, with respect to the back cylinder 2 at a differentiated distance, in such a way that the carding elements arranged downstream of the carding machine are nearer to said back or abutment cylinder, with respect to the carding elements arranged upestream.

In actual practice, a blade or reed element having the disclosed structure and associated with a carding rod has the following characteristics: since a blade is very thin, and has an even hardness, it has a high flexibility degree, thereby it will be held alwajs right and parallel to the other reeds.

Furthermore, that same reed has very polished side walls and has a radius fitted to the curved surface of the drum, thereby obtaining a carding at a 100% rate.

A further very important characteristic is that of providing two types of tooth: that is one for the carding step and the other, a subsequent one, for the cleaning step; the cleaning action is carried out since the shape of the cleaning tooth is such as to convey on the drum all of the fibers being carded.

Thus, since the carding blade is designed in such a way that the fibers, by sliding between the drum and the blade are combed without any stoppings, it will favour a perfect parallelism of the fibers.

This system will afford a universal type of carding, since the thickness of the blade or reed is held unchanged and only the thicknesses of the spacers between the blades are reduced.

The subject blade is stronger than any other covering (card cloth) presently commercially available: infact, the known blades are made from soft tempered steels, whereas the subject blade or reed element has a very great wear resistance since it has a constant hardness.

Moreover the blade or reed elements according to the present invention afford the possibility of increasing the production rate of the carding machine and, in some cases, they provide a double productivity: this is, in particular, also due to its polished structure and to the different types of teeth which render it an auto-cleaning one.

From the above disclosure and from the mentioned figures, the greater functionality and use facility characterizing the carding-rod carding machine for carding fibers in general according to the present invention will be self-evident.

While a preferred embodiment of the carding rods has been disclosed and illustrated by way of an indicative example, it should be noted that it is susceptible to many modifications and variations, all of which come within the spirit and scope of the invention as defined in the accompanying claims.

I claim:

1. A carding-rod carding machine for carding fibers in general, comprising a rotating cylinder, a plurality of carding element supporting elements, extending in a continuous manner near said rotating cylinder, each said carding element consisting of a plurality of carding blades spaced from one another by different thickness spacer elements and circumferentially extending of said rotating cylinder, the inlet end portions of said carding blades being arranged near the outlet end portions of the blades of the carding element located on the preceding supporting element, each said supporting element defining, at the bottom end thereof, an attaching lug of dovetail shape, engaging in a dovetail seat formed in the inner portion of said carding elements, each said supporting element defining, at said attaching lug, a slanted portion for anchoring the carding element, the carding elements arranged downstream of the working region defined by said rotating cylinder being spaced from said rotating cylinder by a distance less than that of the carding elements arranged upstream thereof, each said carding blade being provided with a tooth formation having an arcuate profile and a substantially equal radius as that of said rotating cylinder, said tooth formation consisting of differently shaped alternating fiber pulling and orienting teeth, said fiber pulling teeth including a respective end portion turned in an opposite direction to the fiber advancing direction, said fiber orienting teeth having one end portion symmetrical with respect to the perpendicular to said fiber advancing direction, said fiber pulling teeth being provided, on the front, with a slanted portion meeting with a front beveled portion and, at the rear, with an arcuate portion meeting with a separation groove from said fiber orienting teeth, said fiber orienting teeth being provided with slanted edges meeting with an angle of substantially 60°.

* * * * *